United States Patent [19]

Hannen

[11] Patent Number: 5,024,718

[45] Date of Patent: Jun. 18, 1991

[54] LABEL APPLYING APPARATUS

[75] Inventor: Jakob Hannen, Willich, Fed. Rep. of Germany

[73] Assignee: Kleinewefers GmbH, Krefeld, Fed. Rep. of Germany

[21] Appl. No.: 421,539

[22] Filed: Oct. 13, 1989

[30] Foreign Application Priority Data

Oct. 18, 1988 [DE] Fed. Rep. of Germany ..... 3835407

[51] Int. Cl.[5] ..... B65C 9/12; B65C 9/26; B65C 9/30

[52] U.S. Cl. ..... 156/475; 156/486; 156/570; 156/571; 53/135.1

[58] Field of Search ..... 156/475, 486–492, 156/570–572, 542, 574; 53/137

[56] References Cited

U.S. PATENT DOCUMENTS

| | | | |
|---|---|---|---|
| 3,206,911 | 9/1965 | Carle et al. | 53/137 |
| 3,243,329 | 3/1966 | Anderegg | 156/571 X |
| 3,794,543 | 2/1974 | Bonomi | 156/572 X |
| 4,485,612 | 12/1984 | Piesen | 53/504 |
| 4,596,108 | 6/1986 | Piesen | 53/137 |
| 4,618,392 | 10/1986 | Uchimura et al. | 156/571 X |
| 4,696,715 | 9/1987 | Bahr | 156/571 X |
| 4,725,327 | 2/1988 | Matuda | 156/351 |

FOREIGN PATENT DOCUMENTS

| | | |
|---|---|---|
| 352637 | 9/1979 | Austria . |
| 677885 | 7/1939 | Fed. Rep. of Germany . |
| 3740093 | 6/1988 | Fed. Rep. of Germany . |

*Primary Examiner*—Michael W. Ball
*Assistant Examiner*—Jeff H. Aftergut
*Attorney, Agent, or Firm*—Peter K. Kontler

[57] ABSTRACT

Apparatus for applying labels to the peripheral surfaces or to the end faces of bulky cylindrical objects has a carrier which is transportable up and down as well as toward and away from the labelling station. The carrier supports a suction head which is pivotable about a horizontal axis extending transversely of the direction of movement of the carrier toward and away from the labelling station, and a roll which is rotatable about its own axis as well as pivotable about an axis which is parallel to its own axis and to the pivot axis for the suction head. The latter picks up a horizontal label from a source which is spaced apart from the labelling station, the underside of the label is rendered adhesive while the carrier advances toward the labelling station, the label is then moved into a vertical plane so that its adhesive surface confronts the adjacent surface of the object, and the roll is caused to repeatedly move along and bear against the non-adhesive side of the label in order to apply the label to the object at the labelling station. The movements of the suction head and roll about their respective pivot axes can be carried out independently of each other, the same as the movements of the carrier between different levels and toward and away from the labelling station.

22 Claims, 4 Drawing Sheets

LABEL APPLYING APPARATUS

BACKGROUND OF THE INVENTION

The invention relates to a method of and to an apparatus for applying labels. More particularly, the invention relates to improvements in methods of and in apparatus which can be utilized to apply labels (e.g., large labels) to bulky and heavy objects. Typical examples of bulky and heavy objects are rolls of convoluted paper which are normally draped into envelopes consisting of paper or other material and are ready to be provided with labels prior to leaving the paper making, rolling and draping plant or prior to being transported to storage.

Published German patent application No. 37 40 093 of Turkki discloses a label applying apparatus wherein an arm which is pivotable about a fixed horizontal axis carries a suction plate and a roll. The suction plate attracts a label when it is pivoted to a position remote from a cylindrical body of convoluted paper so that the label overlies the suction plate and the roll and can be severed from a series of coherent labels. The arm is then pivoted toward the cylindrical body so that a portion of the label adheres to the cylindrical body before the latter is set in motion relative to the arm and relative to the suction plate and the roll on the arm.

A drawback of the apparatus of Turkki is that the cylindrical body must be moved relative to the arm in order to entrain the label and to enable the roll to press successive increments of the label against the cylindrical body. As a rule, the cylindrical body is held for rotation about a horizontal axis. A cylindrical body which consists of convoluted paper is very heavy and extremely bulky so that the energy requirements of the conveyor means for such cylindrical body are very pronounced. Moreover, and since the body is very heavy and bulky, it is difficult to bring it to a halt in an optimum position for the application of a label at a selected location. This often necessitates repeated back and forth movements of the conveyor for the cylindrical body. Still further, proper positioning of the label on the suction plate with reference to the roll also presents problems; it happens again and again that only a portion of the label is actually rolled onto the cylindrical body.

The cylindrical body is normally maintained in such orientation that its axis is horizontal. This means that the label is applied in the circumferential direction of the rotating body. If the label is to be applied to the one or the other end face of the cylindrical body, the latter must be moved linearly along a horizontal path past the suction plate and past the roll at the free end of an arm which is then mounted for pivotal movement about a vertical axis. In other words, it is necessary to provide a first apparatus for the application of labels to the peripheral surfaces of cylindrical bodies, and a second apparatus for the application of labels to the end faces of such cylindrical bodies.

U.S Pat. No. 4,725,327 to Matuda et al. discloses a so-called labeling robot which serves to apply labels to block-shaped objects while the objects are mounted on and are transported by a conveyor. The apparatus which is disclosed in this patent exhibits the same drawbacks as the apparatus of Turkki.

German Pat. No. 677,885 to Albersmann discloses a machine which is designed for the application of elongated strip-shaped labels over the closures of bottles. The patented apparatus employs a label feeder which presses one end of an elongated label against the side of the neck of a bottle which is to be provided with a label, and a roll which is mounted on a rather complex linkage and is caused to drape the label around the closure of the bottle. The manner in which the label feeder receives and/or transports the labels is not disclosed; in fact, the patent does not disclose whether the label feeder is movable or stationary. The bottle which is to be provided with a label must be maintained in horizontal position.

Austrian Pat. No. 352,637 to Green Shield Trading Stamp Company Ltd. discloses a label applying machine wherein the object to be provided with a label must be moved on a conveyor past an indexible label-applying turret and thereupon past a roll which is made of foam rubber and is supposed to press the label against the object. The apparatus of this patent is rather complex and exhibits the same drawbacks as the apparatus of Turkki and Matuda et al.

OBJECTS OF THE INVENTION

An object of the invention is to provide an apparatus which is constructed and assembled in such a way that it can apply large, medium-sized or small labels to large, medium-sized or small objects and which can apply labels while the objects to be labelled are held at a standstill.

Another object of the invention is to provide an apparatus whose label-applying action is more reliable than that of heretofore known apparatus and which need not undergo a long-lasting and complex change of setup if it is to be converted for the application of labels to differently dimensioned, configurated and/or oriented objects.

A further object of the invention is to provide the apparatus with novel and improved means for delivering labels to, and with novel and improved means for applying labels at, the labelling station.

An additional object of the invention is to provide an apparatus which can properly apply each and every portion of a label to a flat surface or to an arcuate surface.

Still another object of the invention is to provide the apparatus with novel and improved means for manipulating labels between a source of labels and the labelling station.

A further object of the invention is to provide a novel and improved method of applying labels, such as large or very large labels, to stationary objects, for example, large rolls of paper, cardboard and the like.

Another object of the invention is to provide a method which renders it possible to ensure optimum application of labels to flat or curved surfaces while the object which is to receive a label can remain at a standstill.

An additional object of the invention is to provide a method which ensures proper application of labels under circumstances when a single pass of a roll or an analogous label applying or smoothing tool does not suffice to guarantee reliable application of the label to a selected portion of an object.

A further object of the invention is to provide a method which can be resorted to for predictable application of labels to one and the same portion of each of a short or long series of successive objects.

SUMMARY OF THE INVENTION

One feature of the present invention resides in the provision of an apparatus for applying labels to stationary objects (for example, large cylindrical objects including rolls of paper and the like) at a labelling station. The improved apparatus comprises a carrier, means for transporting the carrier between different levels relative to as well as substantially horizontally toward and away from the labelling station, a label supplying or delivering device which is mounted on the carrier and includes means (e.g., one or more suction heads or cups) for releasably holding a label during transport of the carrier toward the labelling station, a label applying device which is mounted on the carrier and has means for pressing a label against the stationary object at the labelling station during transport of the carrier between different levels, and means for moving at least one of the two devices relative to the other device.

The transporting means preferably includes a first transporting unit which is operative to move the carrier between different levels, and a second transporting unit which is operative to move the carrier toward and away from the labelling station. At least one of the two transporting units is operable independently of the other transporting unit.

The pressing means of the label applying device preferably comprises at least one roll which is rotatable about a first axis (preferably a substantially horizontal axis), and the label holding means is pivotable relative to the carrier about a second axis which is at least substantially parallel to the first axis. The label applying device is pivotable relative to the carrier about a further axis which is at least substantially parallel to the first axis (i.e., to the axis of rotation of the roll). The moving means includes means for pivoting the roll about the further axis, and such pivoting means can comprise a prime mover on the carrier and means for transmitting motion from the prime mover to the roll. Furthermore, the pivoting means comprises means for biasing a label against the stationary object at the labelling station, and such biasing means preferably comprises means for biasing the label with a substantially constant force. The arrangement is preferably such that the pivoting means can pivot the roll back and forth through angles of 120 to 180°. The motion transmitting means preferably includes at least one first lever which supports the roll and is pivotable about the further axis, a shaft which is mounted in or on the carrier and defines the further axis, and at least one second lever which is pivotable about the further axis. The prime mover serves to pivot the at least one second lever. One of the first and second levers (normally the at least one second lever) is rigid with the shaft, and the other of the first and second levers is turnably mounted on the shaft. The biasing means can comprise at least one torsion spring which operates between the shaft and the other lever. The at least one second lever is preferably shorter than the at least one first lever, and the first and second levers preferably make an acute angle.

The transporting means is designed to move the label supplying device along a predetermined path during transport of the carrier toward the labelling station, and the apparatus further comprises activating means which is adjacent the aforementioned path and includes means for rendering adhesive that label which is held by the suction head or suction heads of the label holding means. The activating means can include a device which heats a layer of heat-activatable adhesive on the label, a device which applies an adhesive coat to the label, a device which removes a foil from an adhesive coat on the label, or any other device capable of ensuring that the label which is being transported toward the stationary object is ready to adhere to the object as soon as, or not later than when, it reaches the labelling station.

Another feature of the present invention resides in the provision of a method of applying a label to a stationary object (such as the aforementioned large cylindrical object) at a labelling station. The method comprises the steps of transporting the label from a source of labels against the stationary object at the labelling station, rendering the label adhesive not later than upon arrival at the labelling station, and applying the label to the stationary object at the labelling station including moving a roll relative to and simultaneously pressing the roll against the label. The moving step includes moving the roll in a first direction along and beyond the label and thereupon moving the roll along the label in a second direction, particularly substantially counter to the first direction and preferably along the entire label.

The step of rendering the label adhesive includes rendering adhesive one side of the label, and the method preferably further comprises the step of maintaining the label in such orientation that the one side of the label faces in a direction other than upwardly in the course of each of the aforementioned transporting, rendering adhesive and applying steps.

The transporting step preferably includes the steps of moving the label between different levels and moving the label substantially horizontally. At least one of these moving steps is preferably carried out independently of the other moving step.

The method preferably further comprises the step of transporting the roll with the label between the source of labels and the labelling station.

A presently preferred embodiment of the method includes the additional step of maintaining the label at the source in a substantially horizontal plane, and the transporting step of such method preferably includes pneumatically attracting the label in the substantially horizontal plane and moving the label along substantially horizontal and vertical paths toward the labelling station and turning the label at the labelling station through an angle of approximately or exactly 90° about a substantially horizontal axis. The applying step of this method further comprises moving the roll against the label while the label contacts the stationary object so that the label is clamped between the roll and the object, terminating the attracting step, and moving the roll up and down along the entire label. The attracting step includes holding the label by at least one suction head or suction cup which is pivotable about the horizontal axis.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
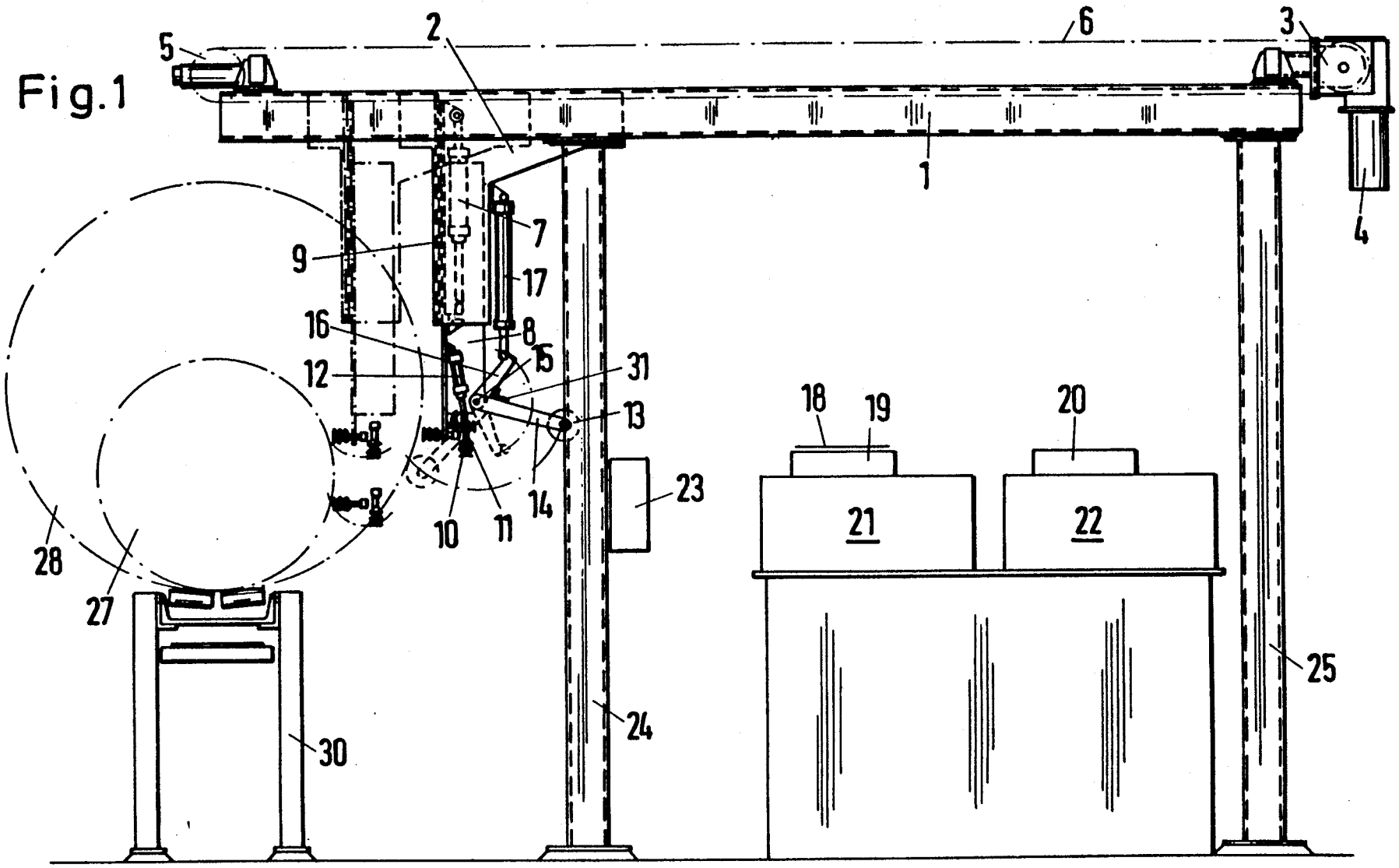
FIG. 1 is a side elevational view of a labelling apparatus which embodies one form of the invention and is in the process of applying labels to cylindrical peripheral surfaces of paper rolls.
Figure 2:
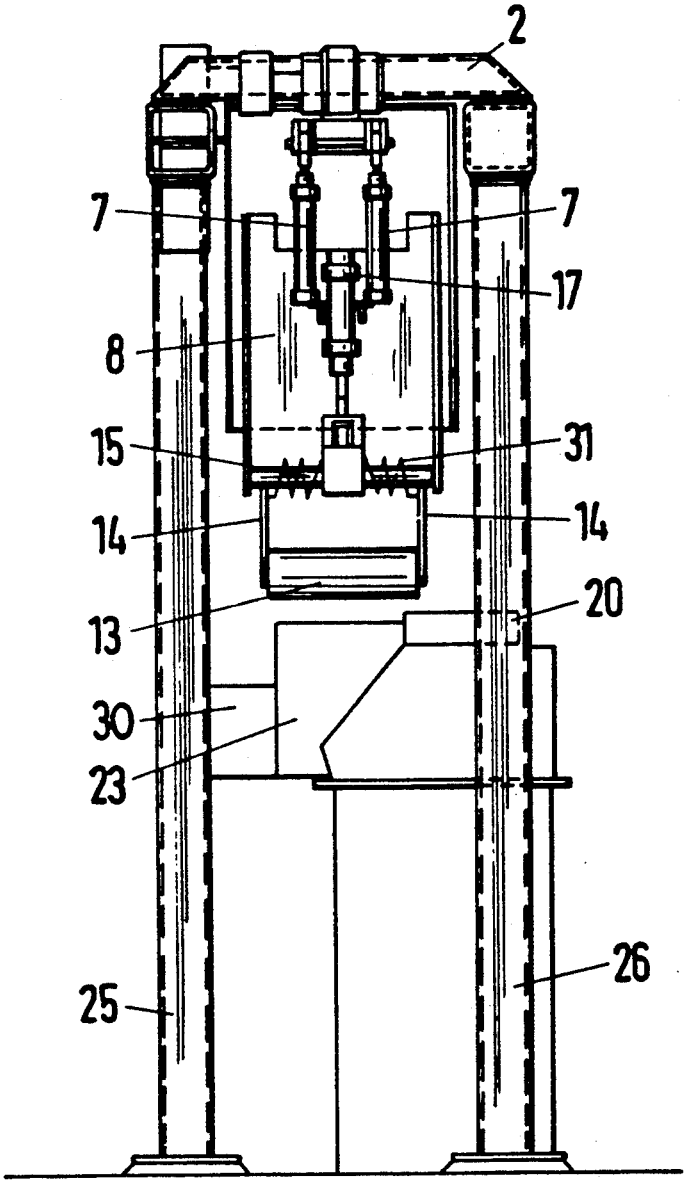
FIG. 2 is a rear elevational view of the apparatus as seen from the right-hand side of FIG. 1.

The labelling or label applying apparatus of FIGS. 1 and 2 comprises a frame 1 which includes upright frame members or columns 24, 25 and 26. The frame 1 supports a mobile carriage or carrier 8 which is movable up and down as well as toward and away from a labelling station (above a conveyor 30 for cylindrical objects 27 or 28) by a transporting means including two transporting units 2–6 and 7. The transporting unit 2–6 is designed to move the carrier 8 along a substantially horizontal path between a source 21 of labels 18 and the labelling station above the conveyor 30, and the unit 7 includes means for moving the carrier 8 between different levels. The arrangement is preferably such that at least one of these units can move the carrier 8 independently of the other unit. The unit 2–6 is designed to move the carrier independently of the unit 7.

The transporting unit 2–6 comprises a vehicle 2 in the form of an overhead trolley which is reciprocable along the upper portion of the frame 1 by a reversible electric or other suitable motor 4 through the medium of a transmission 3 serving to drive one of several pulleys or sprocket wheels 5 for one or more endless flexible elements 6 in the form of belts or chains. A portion of each flexible element 6 is connected to the vehicle 2.

The transporting unit 7 comprises two fluid-operated motors in the form of double-acting hydraulic or pneumatic cylinder and piston units which are mounted on the vehicle 2 and serve to move the carrier 8 up or down along suitable guide means 9 including tracks or rails on the vehicle 2. It will be seen that the fluid-operated motors of the unit 7 can move the carrier 8 up or down while the motor 4 is idle or while the motor 4 is in the process of moving the carrier 8 toward or away from the conveyor 30 at the labelling station. Furthermore, the motor 4 of the transporting unit 2–6 can move the carrier 8 toward or away from the labelling station irrespective of the momentary level of the carrier 8, i.e., irrespective of whether or not the carrier 8 moves along the vertical guide means 9.

Figure 4:
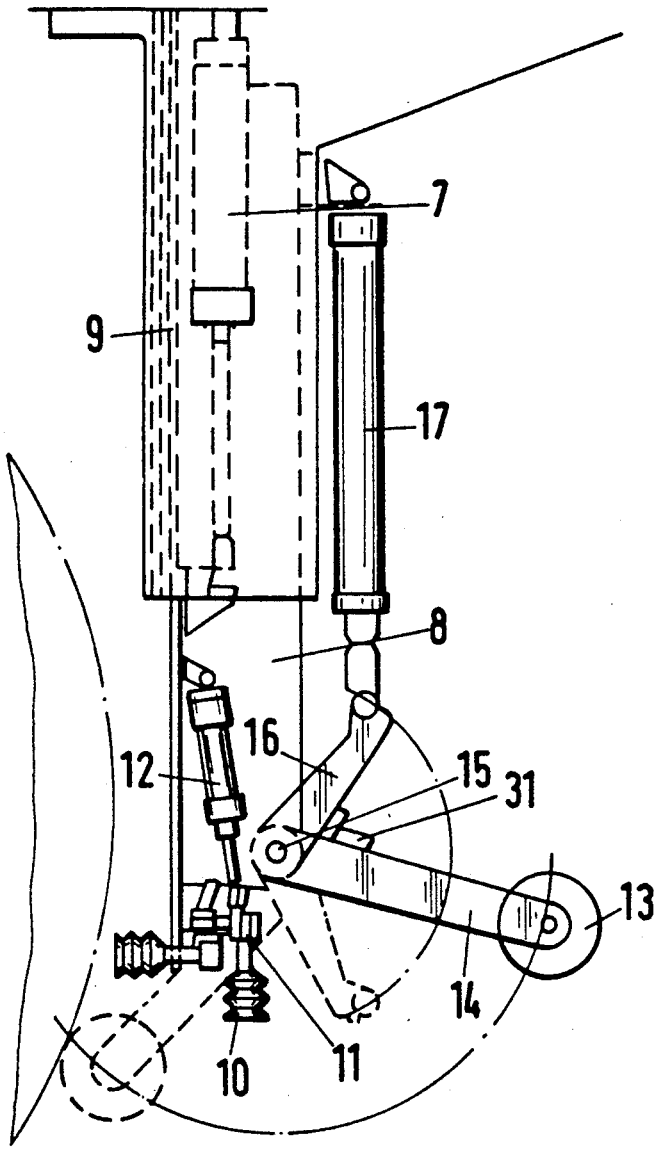
FIG. 4 is an enlarged view of parts of FIG. 1.

With reference also to FIG. 4, the carrier 8 mounts a label supplying device including one or more label holding suction cups or suction heads 10 and a pivot member 11 which is provided on the carrier 8 and defines for the illustrated suction head 10 a horizontal pivot axis extending at right angles to the direction of travel of the vehicle 2. The label supplying device further comprises a fluid-operated motor 12 which is mounted on the carrier 8 and serves to move the suction head 10 about the axis of the pivot member 11. The suction head 10 comprises a venturi which causes a label 18 to adhere thereto for delivery of the label from the source 21 to an object 27 or 28 on the conveyor 30 at the labelling station. The length of the venturi decreases when it is in the process of attracting a label 18 so that the label is lifted off its support 19 at the source 21. The arrangement is such that, when the carrier 8 is retracted (moved away from the labelling station by the transporting unit 2–6), the suction head 10 is adjacent and can attract the leftmost portion of the label 18 on the support 19.

The carrier 8 further mounts a label applying device including a roll 13 rotatable about a horizontal axis which is parallel to the axis of the pivot member 11 for the suction head 10, and means for pivoting the roll 13 about a further horizontal axis defined by a shaft 15 which is mounted in or on the carrier 8 and is parallel to the pivot member 11. The pivoting means comprises two first levers 14 which are pivotable on the shaft 15 and the free ends of which have suitable bearings for the respective end portions of the roll 13, a second lever 16 which is rigid with the shaft 15, and a prime mover 17 which is mounted on the carrier 8 and serves to pivot the lever 16 to thereby turn the shaft 15 which, in turn, pivots the levers 14 and the roll 13 through the medium of biasing means in the form of torsion springs 31 surrounding the shaft 15, reacting against this shaft or against the lever 16 and bearing against the levers 14. The levers 14 make with the lever 16 an acute angle and are longer than the lever 16. The prime mover 17 is a double-acting fluid-operated cylinder and piston unit which can pivot the lever 16 and the levers 14 with roll 13 through angles of 120 to 180°.

The source 21 can include a printer which serves to apply to the respective side (underside) of the label 18 on the support 19 printed matter including the name of the manufacturer of objects 27, 28, the date of application of the label, the weight of the object to which the label is to be applied, the destination of the object 27 or 28 and/or other information. A second source 22 with a support 20 is adjacent the source 21 and serves to contain a supply of different labels or an additional supply of labels 18.

The conveyor 30 is designed to support cylindrical objects 27, 28 having different diameters. The objects are delivered to the labelling station in such orientation that their axes are parallel or substantially parallel to the axes of the pivot member 11 for the suction head 10, shaft 15 and roll 13.

Figure 3:
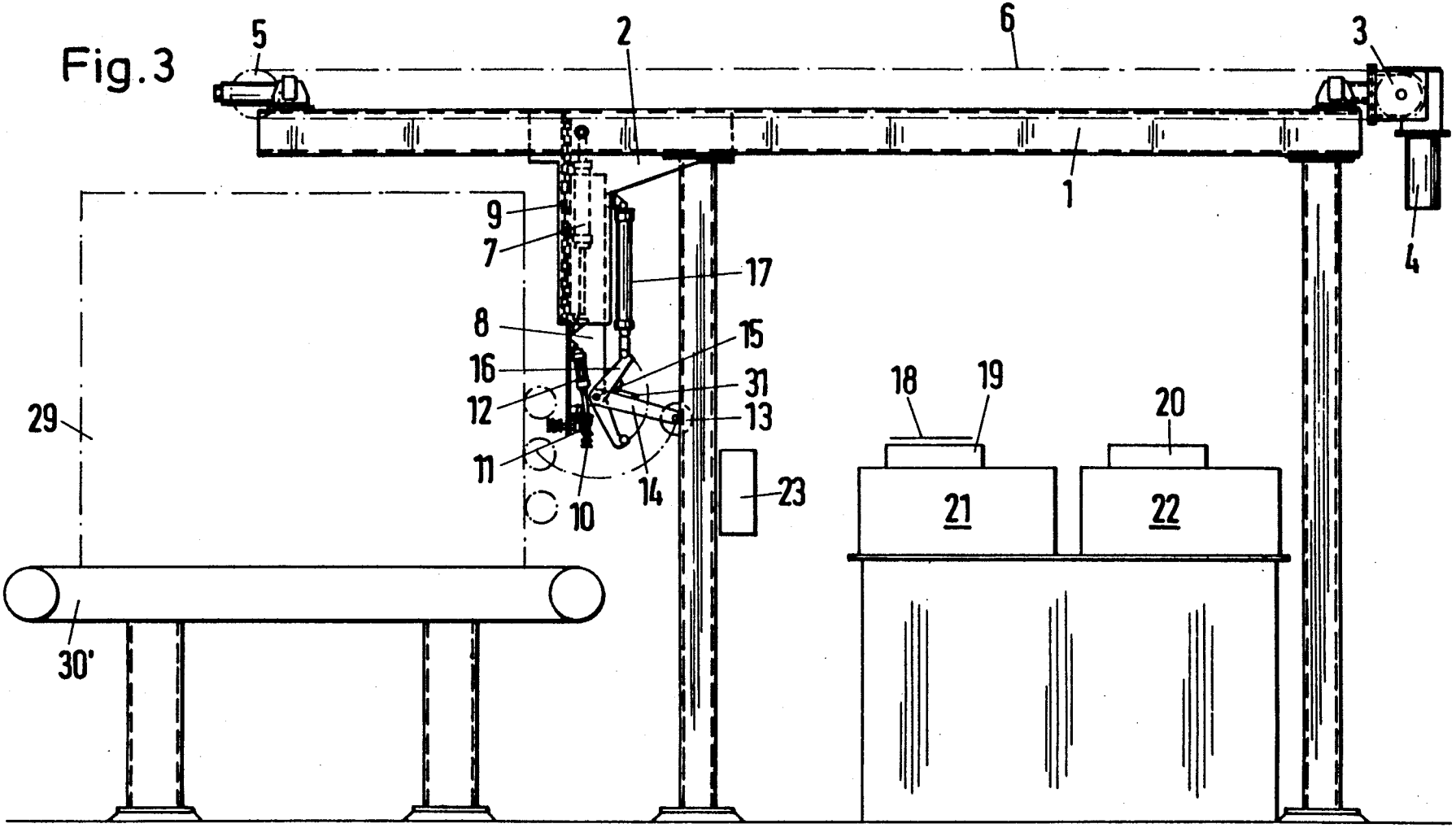
FIG. 3 is a side elevational view of a modified apparatus which is in the process of applying a label to one end face of a cylindrical paper roll.

FIG. 3 shows a modified conveyor 30′ which is designed to deliver large cylindrical objects 29 in such orientation that the axis of the object on the conveyor 30′ is horizontal or nearly horizontal and extends at right angles to the axes of the pivot member 11, roll 13 and shaft 15. In all other respects, the apparatus of FIG. 3 is or can be identical with the label applying apparatus of FIGS. 1 and 2. Thus, one and the same apparatus can serve to apply labels 18 to the cylindrical peripheral surfaces of large and heavy cylindrical objects (27, 28 in FIG. 1) or to the flat end faces of such objects (note the object 29 of FIG. 3).

The operation of the apparatus of FIGS. 1 and 2 is as follows:

In order to pick up a fresh label 18, the carrier 8 and the suction head 10 are moved to the right by starting the motor 4 so that the flexible element or elements 6 of the transporting unit 2–6 can advance the vehicle 2 to a position above the source 21. At such time, the transporting unit 7 maintains the suction head 10 at least slightly above the horizontal plane of the label 18 on the support 19 of the source 21. The unit 7 can lift the suction head 10 while the vehicle 2 is in the process of moving away from the labelling station; this is due to the fact that the transporting units 2–6 and 7 can operate independently of each other.

The unit 7 is actuated to lower the suction head 10 when the latter is located above the label 18 on the support 19, and the suction head 10 then attracts the adjacent left-hand marginal portion of the label 18 before the motor 4 is caused to move the carrier 8 toward the conveyor 30 whereby the underside of the entrained label 18 advances above and past a device 23 which serves to render the label 18 adhesive not later than when the label is ready to be applied to the cylindrical peripheral surface of the object 27 or 28 at the labelling station. If the underside of the label 18 is already coated with a layer of adhesive, the device 23 can be designed to spray water onto the underside of the label 18 while the latter advances along its path from the support 19 toward the conveyor 30. If the underside of the label 18 on the support 19 is devoid of adhesive, the device 23 can serve to roll, spray or brush a layer of liquid or liquefied adhesive onto the underside of the label which advances toward the conveyor 30. If the underside of the label 18 on the support 19 carries a layer of hotmelt, the device 23 can include means for heating and for thus activating the hotmelt so that the label 18 is ready to adhere to the peripheral surface of the object 27 or 28 when it reaches the labelling station. Still further, the device 23 can be designed to spray a suitable solvent other than water against a layer of hardened adhesive at the underside of the label 18 which is about to be applied to an object at the labelling station. All that counts is to ensure that the label which reaches the conveyor 30 is capable of adhering to the object on such conveyor. The device 23 can also comprise means for removing (e.g., peeling off) a foil which overlies an adhesive layer at the underside of the label 18 advancing with the suction head 10 toward the labelling station.

When the label 18 reaches the labelling station, the motor 12 is actuated to turn the suction head 10 about the axis of the pivot member 11 through an angle of approximately or exactly 90° and in a clockwise direction (as seen in FIG. 1) so that the adhesive side of the thus reoriented label confronts the peripheral surface of the object 27 or 28. In other words, and if the label 18 which is attracted to the suction head 10 is relatively stiff, the motor 12 can change the orientation of such label by causing the label to move from a substantially horizontal plane into a substantially vertical plane. The motor 4 comes to a halt when the label 18 (which is then located in a substantially vertical plane) reaches the object 27 or 28 on the conveyor 30. This can be accomplished by employing suitable sensor means which monitors the position of the suction head 10 and/or label 18 with reference to the object on the conveyor 30.

Alternatively, the motor 4 can be brought to a halt when the label 18 which is attracted by the suction head 10 is still slightly spaced apart from the object 27 or 28. For example, the motor 4 can arrest the carrier 8 when the turning of the suction head 10 through 90° (by the motor 12) is completed and the label 18 is located in a vertical plane which is practically or substantially tangential to the peripheral surface of the object 27 or 28.

The next step involves pivoting of the lever 16 by the prime mover 17 (in a clockwise direction, as seen in FIG. 1) so that the lever 16 turns the shaft 15 which causes the torsion springs 31 to pivot the levers 14 with the roll 13. The latter moves against the lower marginal portion of the label 18 and clamps it against the peripheral surface of the object 27 or 28. The suction head 10 then releases the adjacent (upper) marginal portion of the label 18 or discharges one or more jets of compressed air or another gaseous fluid in order to urge the upper marginal portion of the label against the peripheral surface of the object 27 or 28. A further step involves pivoting the suction head 10 about the axis of the pivot member 11 back to the original position in which the suction head is ready to lift a fresh label off the support 19 as soon as the carrier 8 returns to a position above the source 21. The suction head 10 is then out of the way and the transporting unit 7 is actuated to move the carrier 8 upwardly along the guide means 9 while the torsion springs 31 continue to bias the roll 13 against the uncoated (non-adhesive) side of the label 18 with a preferably constant force. The generation of such constant force is ensured by the prime mover 17 which is designed to urge the lever 16 clockwise (as seen in FIG. 1) in order to stress the springs 31 and to maintain the roll 13 in requisite engagement with the uncoated side of the label 18. If the prime mover 17 is connected with a source of compressed gaseous or hydraulic fluid, it is merely necessary to ensure that the pressure in the upper chamber of the cylinder of the prime mover 17 is constant while the transporting unit 7 moves the carrier 8 from a lower level to a higher level (by moving the carrier 8 along the guide means 9) in order to press successive increments of the label 18 against the cylindrical peripheral surface of the object 27 or 28. Thus, the prime mover 17 cooperates with the torsion springs 31 to account for the fact that the label 18 must be applied to a cylindrical surface.

When the carrier 8 rises to a level at which the roll 13 has advanced beyond the label 18 on the object 27 or 28, the direction of movement of the carrier 8 along the guide means 9 is preferably reversed so that the roll 13 begins to ride along the exposed side of the already applied label 18 but in the opposite direction. The prime mover 17 continues to cooperate with the torsion springs 31 in order to ensure that the roll 13 remains in requisite contact with the exposed side of the label. The just described step of moving the roll 13 upwardly and thereupon downwardly contributes to the reliability of application of the label 18 to the object 27 or 28 and ensures that each and every portion of the label adheres to the adjacent portion of the cylindrical surface of the object on the conveyor 30. It is clear that the roll 13 can be caused to move along the exposed side of a label 18 on the object 27 or 28 three or more times, or only once. This depends upon the selected setting of controls for the transporting unit 7 and prime mover 17.

An advantage of the means (14 to 17 and 31) for pivoting the roll 13 about the axis of the shaft 15 is that one and the same apparatus can apply labels to different objects, e.g., to objects (27) having smaller diameters or to objects (28) having larger diameters. Moreover, the apparatus can apply labels to flat or arcuate surfaces. As can be seen in FIG. 3, the cylindrical object 29 on the somewhat modified conveyor 30′ is held in such orientation that one of its end faces is adjacent the suction head 10 and the roll 13 and is ready to receive a label 18 which is applied in the same way as described above with reference to the apparatus of FIGS. 1 and 2 except that the angular positions of the levers 16, 14 need not change while the carrier 8 is caused to move along the guide means 9. On the other hand, the levers 14 pivot first in a counterclockwise direction and thereupon in a clockwise direction when the roll 13 of the apparatus which is shown in FIG. 1 is caused to move upwardly while urging a label 18 into contact with the cylindrical peripheral surface of the object 27 or 28. The levers 14 thereupon pivot first counterclockwise and then clockwise while the carrier 8 descends in order to enable the roll 13 to press the label 18 against the object for the second time.

When the label applying step is completed, the prime mover 17 is caused to pivot the roll 13 back to a starting position and the carrier 8 is moved upwardly so that the suction head 10 is located at a level above the label 18 on the support 19 of the source 21. The motor 4 is then started to move the carrier 8 with the suction head 10 and roll 13 away from the labelling station. At the same time, the conveyor 30 or 30' is caused to deliver a fresh object 27, 28 (FIG. 1) or 29 (FIG. 3) to the labelling station. The aforediscussed operation is then repeated, i.e., the label 18 which is attracted by the suction head 10 is rendered adhesive by the device 23 and is ready to be applied to the freshly delivered object at the respective labelling station.

The various motors and prime movers can include or constitute electric motors, hydraulic motors or pneumatic motors. If the operation of the improved apparatus is automated, the motors and prime movers are operated in a predetermined sequence, for predetermined intervals of time and in predetermined directions in order to ensure that the application of labels can be carried out at a desired frequency and that each label is properly applied to a selected portion of the respective object. The exact nature of control means and programming means for the motors and prime movers of the improved apparatus forms no part of the invention.

The improved apparatus exhibits the advantage that it is not necessary to change the setup in order to convert from the application of labels to flat surfaces to the application of labels to arcuate surfaces or vice versa. Another very important advantage of the improved apparatus is that the object remains stationary while the roll 13 is in the process of applying a label thereto. This is particularly advantageous when the objects to be labelled are very large and extremely heavy. Typical examples of such objects are heavy paper rolls. Reference may be had to commonly owned U.S. Pats. Nos. 4,485,612 and 4,596,108 which disclose apparatus for applying envelopes to and for otherwise manipulating large rolls of convoluted paper and other webs or strips of flexible material.

A further important advantage of the improved apparatus is that labelling of relatively small objects (27) can be followed by labelling of larger objects (28) or by labelling of objects (29) which are maintained in a different orientation than the previously labelled objects. For example, if the apparatus of FIG. 1 is to shift from the application of labels to larger objects 28 to the application of labels to smaller objects 27, it is merely necessary to advance the carrier 8 farther to the left and to move the carrier 8 to a lower level. The corresponding positions of the carrier 8 and of the guide means 9 for the carrier are shown in the left-hand portion of FIG. 1 by phantom lines.

The sources 21, 22 can be mounted on a turntable or on another suitable conveyor so that each thereof can be moved to an optimum position for maintaining successive labels in a state of readiness to be picked up by the suction head 10 or by a suction table or strip with two or more suction heads. Moreover, it is possible to raise or lower at least one of the sources 21, 22 and the respective support 19, 20 if a movement to a different level is desirable for more convenient engagement of the labels 18 by the suction head 10. For example, the source 21 can include a printer having a height such that it extends to a level above the source 22. The latter (or the source 21) can consist of a simple table or platform which is capable of receiving a stack of superimposed labels 18. The versatility of the improved apparatus can be selected practically at will, the same as the extent of automation. It is also possible to rely on manual operation of some or all of the motors, prime movers, conveyors and other parts which must be actuated or operated from time to time in the course of a labelling operation.

An additional important advantage of the improved apparatus is that it can apply large, medium-sized or relatively small labels with the same facility and with the same degree of reliability. In fact, the upper limit as concerns the size of the labels is imposed exclusively by the dimensions of the frame 1 and by the ability of the label supplying device to transport a large label past the device 23 and toward actual contact with the object at the labelling station. The weight and/or bulk of the objects to be labelled is immaterial because the objects are stationary as soon as they reach the labelling station and remain stationary during the application of labels thereto. This contributes significantly to the accuracy and predictability of application of labels to such bulky and heavy objects. The absence of acceleration and/or deceleration of the object during application of a label thereto is a very important factor which enhances the reliability and reproducibility of the label applying operation.

Since the suction head 10 is pivotable about the axis of the pivot member 11 independently of pivoting of the roll 13 about the axis of the shaft 15, the improved apparatus can be used with equal advantage for renewed pressing of already applied labels to the respective objects. For example, if the labels are applied at a station which is disposed ahead of the conveyor 30 or 30', the suction head 10 is simply deactivated and moved out of the way while the roll 13 is used to apply pressure to the labels on objects which are delivered by the conveyor 30 or 30'. Thus, the improved apparatus can be used as a means for ensuring proper retention of labels which were applied in conventional apparatus wherein the pressing of adhesive-coated labels to flat or arcuate surfaces is not as reliable as in accordance with the method and the apparatus of the present invention.

The improved apparatus can also serve for the application of different labels to successive objects irrespective of whether successive objects are identical or different in size and/or shape. Thus, and referring for example to FIG. 1, the apparatus which is shown therein can be used to pick up a first label 18 from the source 21 for application to an object 27, to thereupon pick up a different second label from the source 22 for application to the next object 27 or to an object 28, and so forth. The number of sources of different labels can be increased to three or more without departing from the spirit of the invention. All that is necessary is to ensure that a label which is picked up at a more distant station can move over the topmost label at the other station or stations during transport toward the labelling station.

It is further possible to employ the improved apparatus for the application of extremely large labels which cannot be properly oriented by a single suction head or an analogous label holding device. Thus, the suction head 10 or two or more suction heads can be used to simply drag a large label toward the object at the labelling station, even if the label is incapable of remaining in a horizontal plane during movement from the source toward the object to which it is to be applied.

It goes without saying that the improved apparatus can be used with equal advantage for the application of labels to non-cylindrical objects, for example, to box-shaped objects or to elongated flat objects. The objects need not contain paper and need not be draped in paper or other wrapping material.

A further important advantage of the improved apparatus is that the orientation of a label can be changed, practically to any desired extent, during transport toward and/or upon completed delivery to the labelling station. This renders it possible to ensure optimum orientation of labels during each and every stage of their manipulation, i.e., during storage in the source 21 or 22, during picking up from the respective source, during transport toward and past the device 23 as well as preparatory to movement of the roll 13 into engagement with the non-adhesive side of the label. As shown in FIG. 3, the just discussed versatility of the improved apparatus renders it possible to store and transport labels while the labels are maintained in one or more horizontal planes, and to thereupon apply the labels to surfaces which are located in a vertical plane.

The ability of the suction head 10 to pivot about the axis of the pivot member 11 renders it possible to move the suction head out of the way when the roll 13 is ready to apply pressure against the non-adhesive side of the label on the object at the labelling station and to move along the label, once or more than once, in order to ensure predictable and satisfactory application of each and every adhesive-coated portion of the label to the respective object.

The ability of the roll 13 to pivot about the axis of the shaft 15 independently of pivoting of the suction head 10 about the axis of the pivot member 11 also constitutes a desirable and advantageous feature of the improved method and apparatus. Thus, the roll 13 can be kept out of the way to facilitate the manipulation of labels by the suction head 10 between the source of labels and the object at the labelling station. It has been found that the ability of the roll 13 to pivot about the axis of the shaft 15 through angles of 120 to 180° suffices to ensure that the roll 13 cannot interfere with the manipulation of labels by the suction head 10. Once a label is properly positioned with reference to the object at the labelling station, the prime mover 17 is caused to pivot the roll 13 in a clockwise direction (as seen in FIG. 1 or 3) in order to ensure that the roll clamps the lower marginal portion of the label against the adjacent surface of the object preparatory to preferably repeated movement of the roll along the entire non-adhesive surface of the label.

Those end portions of the levers 14 which are remote from the shaft 15 can be provided with self-adjusting bearings (e.g., pendulum bearings) for the respective end portions of the shaft of the roll 13. The feature that the lever 16 is shorter than the levers 14 and that the levers 14 make with the lever 16 an acute angle is desirable and advantageous because this ensures that a relatively short stroke of the piston rod of the prime mover 17 suffices to pivot the roll 13 about the axis of the shaft 15 through a relatively large angle of 120 to 180°. Such desirable transmission ratio renders it possible to employ a relatively short prime mover 17. The axis of the piston rod of the prime mover 17 is always inclined with reference to the lever 16 to thus ensure that the prime mover 17 can invariably exert pressure which causes the roll 13 to move along an arcuate path about the axis of the shaft 15 and to bear against the label 18 with a requisite force (also under the bias of the torsion springs 31) when the carrier 8 is in the process of moving along the guide means 9 in order to exert pressure against the non-adhesive side of the label.

The roll 13 can be provided with an elastically deformable peripheral layer, e.g., a layer which consists of or contains foam rubber. The prime mover 17 of the means for pivoting the roll 13 need not be designed to transmit a large force irrespective of the size and weight of the objects to be labelled because the labels are applied to stationary objects and the force which is transmitted by the prime mover 17 to the roll 13 must merely suffice to ensure proper application of a large or smaller label without wrinkling and in such a way that each and every adhesive-coated portion of the label adheres to the adjacent portion of the external surface of the object at the labelling station. The mass of the carrier 8 and of the parts which are mounted on the carrier is relatively small to thus ensure that relatively small transporting units suffice to move the carrier up and down as well as toward and away from the labelling station with a very high degree of predictability and reproducibility. All or many of these features are attributable to the fact that the object to be labelled need not be kept in motion during application of a label to its flat, cylindrical or otherwise configurated external surface.

Repeated movability of the roll 13 along the non-adhesive side of a label on the object at the labelling station is particularly desirable when the marginal portions of the labels tend to curl and move away from the adjacent surfaces of the objects. It has been found that, once the roll 13 has been caused to move up and down along the entire non-adhesive side of a label on the object at the labelling station, the tendency of the marginal portions of such label to move away from the external surface of the object is much less pronounced or nil. Curling of marginal portions away from the adjacent surfaces of the objects gives rise to separation of entire labels or to tearing of labels so that the information which is borne by the labels is lost or cannot be readily or reliably read or decoded.

It is preferred to select the orientation of labels in the improved apparatus in such a way that the adhesive-coated side of a label (or that side of the label which is to be coated with adhesive or on which the adhesive is to be activated by the addition of moisture and/or by heating) never faces upwardly. As can be seen in FIGS. 1 and 3, that side of a label which is to be attached to an object on the conveyor 30 or 30' faces downwardly on the support 19 or 20 as well as during transport toward and past the device 23, and is thereupon moved into a substantially vertical plane preparatory to its application to the respective object 27, 28 or 29. Such orientation of labels is desirable and advantageous because it reduces the likelihood of accidental application of adhesive, water or solvent to that side of the label which is exposed subsequent to application of the label to an object. Patches of adhesive or solvent, or even water-containing spots would be likely to detract from the appearance of the applied label and would render it likely that the applied label would tend to adhere to a surface which happens to come into contact with unintentionally applied adhesive.

The feature that the carrier 8 mounts the suction head 10 as well as the roll 13 contributes to compactness and simplicity of the improved apparatus. For example, if the roll 13 were permanently installed adjacent the labelling station, it could and probably would interfere with movements of the label toward the object at the labelling station, i.e., it would be necessary to provide discrete means for moving the roll out of the way during transport of a label toward the labelling station.

Figure 5:
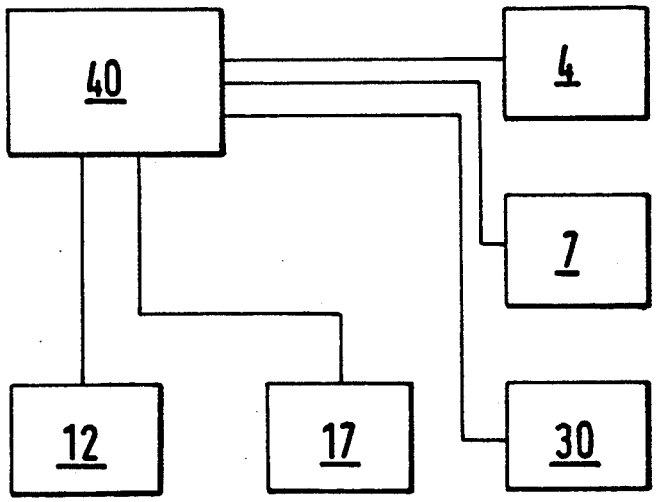
FIG. 5 is an arrangement for controlling the movement of parts of the labelling apparatus.

As shown in FIG. 5, the operations of motor 4, unit 7, conveyor 30, motor 12, and prime mover 17 are controlled by a controlling unit 40 which actuates the above parts in a predetermined sequence.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for applying labels to stationary objects at a labelling station, comprising a carrier; means for transporting said carrier between different levels relative to as well as substantially horizontally toward and away from the labelling station; a label supplying device mounted on said carrier and including means for releasably holding a label during transport of said carrier toward the labelling station; a label applying device mounted on said carrier and having means for pressing a label against the stationary object at the labelling station during transport of said carrier between different levels so that said pressing means moves along the label while exerting a force on the same, said transporting means including means for moving said carrier in a first direction and then in a second direction while said pressing means bears against the label; and means for moving at least one of said devices relative to the other of said devices.

2. The apparatus of claim 1, wherein said transporting means includes a first transporting unit which is operative to move said carrier between different levels and a second transporting unit which is operative to move said carrier toward and away from the labelling station, at least one of said units being operable independently of the other of said units.

3. The apparatus of claim 1, wherein said pressing means comprises a roll which is rotatable about a first axis, said label holding means being pivotable relative to said carrier about a second axis which is at least substantially parallel to said first axis.

4. The apparatus of claim 1, wherein said pressing means comprises a roll which is rotatable about a first axis, said label applying device being pivotable relative to said carrier about a second axis which is at least substantially parallel to said first axis.

5. The apparatus of claim 4, wherein said moving means includes means for pivoting said roll about said second axis.

6. The apparatus of claim 5, wherein said pivoting means includes a prime mover on said carrier and means for transmitting motion from said prime mover to said roll.

7. The apparatus of claim 5, wherein said pivoting means includes means for biasing a label against the stationary object at the labelling station.

8. The apparatus of claim 7, wherein said biasing means includes means for biasing the label with a substantially constant force.

9. The apparatus of claim 5, wherein said pivoting means includes means for pivoting said roll back and forth through angles of substantially 120–180°

10. The apparatus of claim 1, wherein said transporting means includes means for transporting said label supplying device along a predetermined path during transport of said carrier toward the labelling station, and further comprising activating means adjacent said path and including means for rendering adhesive that label which is held by said holding means.

11. The apparatus of claim 1, wherein said second direction is substantially counter to said first direction.

12. A method of applying a label to a stationary object at a labelling station, comprising the steps of transporting the label from a source of labels to the labelling station; rendering the label adhesive not later than upon arrival at the labelling station; and applying the label to the stationary object at the labelling station including moving an applicator relative to and simultaneously pressing the applicator against the label so that the applicator moves along the label while exerting a force on the same, said moving step including moving the applicator along the label in a first direction and then moving the applicator along the label in a second direction.

13. The method of claim 12, wherein said applicator comprises a roll.

14. The method of claim 12 of applying a label which has a first side to be moved into contact with the stationary object and a second side, wherein said step of rendering the label adhesive includes rendering adhesive the first side of the label; and further comprising the step of maintaining the label in such orientation that the first side of the label faces in a direction other than upwardly in the course of each of said transporting, rendering adhesive and applying steps.

15. The method of claim 12, wherein said transporting step includes the steps of moving the label between different levels and substantially horizontally, at least one of said label moving steps being carried out independently of the other of said label moving steps.

16. The method of claim 12, further comprising the step of transporting the roll with the label between the source and the stationary object at the labelling station.

17. Apparatus for applying labels to stationary objects at a labelling station, comprising a carrier; means for transporting said carrier between different levels relative to as well as substantially horizontally toward and away from the labelling station; a label supplying device mounted on said carrier and including means for releasably holding a label during transport of said carrier toward the labelling station; a label applying device mounted on said carrier and having means for pressing a label against the stationary object at the labelling station during transport of said carrier between different levels, said pressing means comprising a roll which is rotatable about a first axis; and means for moving at least one of said devices relative to the other of said devices, said moving means comprising means for pivoting said roll about a second axis which is at least substantially parallel to said first axis, and said pivoting means including at least one first lever supporting said roll and pivotable about said second axis, a shaft mounted in said carrier and defining said second axis, at least one second lever pivotable about said second axis, and prime mover means for pivoting said at least one second lever, one of said first and second levers being rigid with said shaft and the other of said first and second levers being turnably mounted on said shaft, said pivoting means further including at least one torsion spring operating between said shaft and said other lever.

18. The apparatus of claim 17, wherein said at least one second lever is rigid with said shaft and is shorter than said at least one first lever, said at least one first lever making an acute angle with said at least one second lever.

19. A method of applying a label to a stationary object at a labelling station, comprising the steps of transporting the label from a source of labels against the stationary object at the labelling station; rendering the label adhesive not later than upon arrival at the labelling station; and applying the label to the stationary object at the labelling station including moving a roll relative to and simultaneously pressing the roll against the label, said moving step including moving the roll in a first direction along and beyond the label and thereupon moving the roll along the label in a second direction.

20. The method of claim 19, wherein said second direction is substantially counter to the first direction and said moving step includes moving the roll in the second direction along the entire label.

21. A method of applying a label to a stationary object at a labelling station, comprising the steps of maintaining the label in a substantially horizontal plane at a source of labels; transporting the label from the source against the stationary object at the labelling station, said transporting step including penumatically attracting the label in said plane, moving the label along substantially horizontal and vertical paths toward the labelling station, and turning the label at the labelling station through substantially 90 degrees about a substantially horizontal axis; rendering the label adhesive not later than upon arrival at the labelling station; and applying the label to the stationary object at the labelling station, said applying step including moving a roll against the label while the label contacts the stationary object so that the label is clamped between the roll and the object, terminating the attracting step, and moving the roll relative to, while simultaneously pressing the roll against, the label, said roll moving step including moving the roll up and down along the entire label.

22. The method of claim 21, wherein said attracting step includes holding the label by at least one suction head which is pivotable about the horizontal axis.

* * * * *